United States Patent [19]

Nelson

[11] Patent Number: 4,614,502

[45] Date of Patent: Sep. 30, 1986

[54] TELESCOPING STRUT MEMBERS AND TENDONS FOR CONSTRUCTING TENSILE INTEGRITY STRUCTURES

[76] Inventor: William A. Nelson, 52 High St., Middlebury, Vt. 05753

[21] Appl. No.: 710,629

[22] Filed: Mar. 11, 1985

[51] Int. Cl.[4] ..... A63H 33/00

[52] U.S. Cl. ..... 446/119; 52/645; 52/648; 52/DIG. 10; 135/106

[58] Field of Search ..... 52/81, 648, 645, DIG. 10; 135/106; 446/119

[56] References Cited

U.S. PATENT DOCUMENTS

| | | | |
|---|---|---|---|
| 3,422,565 | 1/1969 | Kentfield et al. | 446/119 |
| 3,866,366 | 2/1975 | Fuller | 52/648 X |
| 3,901,551 | 8/1975 | Wiesner | 52/648 X |
| 3,970,301 | 7/1976 | Lehmann | 52/DIG. 10 |
| 4,148,520 | 4/1979 | Miller | 52/648 X |
| 4,236,543 | 12/1980 | Moss | 135/106 |
| 4,404,240 | 9/1983 | Varela | 52/DIG. 10 |
| 4,449,348 | 5/1984 | Jacobs | 52/648 |

FOREIGN PATENT DOCUMENTS

| | | | |
|---|---|---|---|
| 220444 | 6/1958 | Australia | 135/106 |
| 2396129 | 3/1979 | France | 52/DIG. 10 |

*Primary Examiner*—J. Karl Bell

[57] ABSTRACT

A construction kit consisting of telescoping strut members and pre-measured elastic or inelastic tendons, for the purpose of constructing tensile-integrity structures. The invention is made of reusable elements. By introducing struts which can be adjusted to various lengths the invention circumvents the necessity of measuring, cutting and tying different lengths of tendons for different structures and considerably simplifies the construction process.

3 Claims, 7 Drawing Figures

TELESCOPING STRUT MEMBERS AND TENDONS FOR CONSTRUCTING TENSILE INTEGRITY STRUCTURES

BACKGROUND OF THE INVENTION

The present invention relates to a construction kit comprising telescoping strut members and tedons, which may be either elastic or inelastic, permitting the easy construction of a wide variety of tensile integrity (or "tensegrity") structures of the type patented by R. B. Fuller, U.S. Pat. No. 3,063,521, and described, for example, in A. Pugh, An Introduction to Tensegrity (University of California Press 1976).

The type of structure which can be built from this invention was invented by Fuller in 1959, and various methods of construction have since been proposed by Pugh and others. To create rigid and correctly proportioned tensegrity structures the length of the tendons must be precisely related to the length of the struts. The ratio of tendon length to strut length is different for different structures, varying from approximately 0.51 to approximately 0.35. The methods heretofore in use all involve struts of a fixed length, and therefore all require an exacting and time-consuming process of precisely measuring the tendons and cutting them and typing knots at the length appropriate for each given structure. (Because many of the structures are complex and difficult to visualize, the builder has been encouraged to construct first a rough model, using rubber band tendons and a different type of strut, from which she can eventually fashion a more elegant version. See e.g. Pugh, supra, App. 1, pp. 69–76.).

The principal innovation introduced by my invention, the use telescoping struts, reverses the process. The struts being extendable to varying lengths, the length of the tendons can be fixed and pre-measured for all structures. Construction is thereby greatly simplified. The elements are fully reusable: a given structure can be disassembled and a new structure built from the same parts.

SUMMARY OF THE INVENTION

The invention is embodied in a construction kit consisting of rigid but telescoping strut members and elastic or inelastic tendons. The struts are so constructed that two premeasured lengths of thread can be securely attached to the two ends of each strut, like a bow with two strings. The ends of each strut are also constructed so as to enable the user to connect an end of one strut to any point along one of the strings attached to a second strut. (There are any number of means by which struts and strings can be suitably connected together; the preferred method is shown in the drawing and explained in my description of the preferred embodiments, post.) Struts and strings may be fastened together in this way to form two- or three-dimensional tensegrity figures. Once all the connections have been made some or all of the telescoping struts may be lengthened or shortened to adjust the tension in the strings and bring the structure into symmetry.

The purpose of the invention is to permit the relatively easy construction of the full range of Fuller's elegant and sometimes quite complicated tensegrity structures, making that inaccessable class of structure the subject of a simple construction kit. The invention makes use of reusable parts; finished models can be built without requiring the builder first to construct a rough version from which a final version may be made, or to measure the length of the tendons (which given a fixed strut length, is different for different structures).

An important object of the invention is to provide a construction kit which serves educational as well as recreational and design purposes.

Description of the Preferred Embodiments

Figure 1:
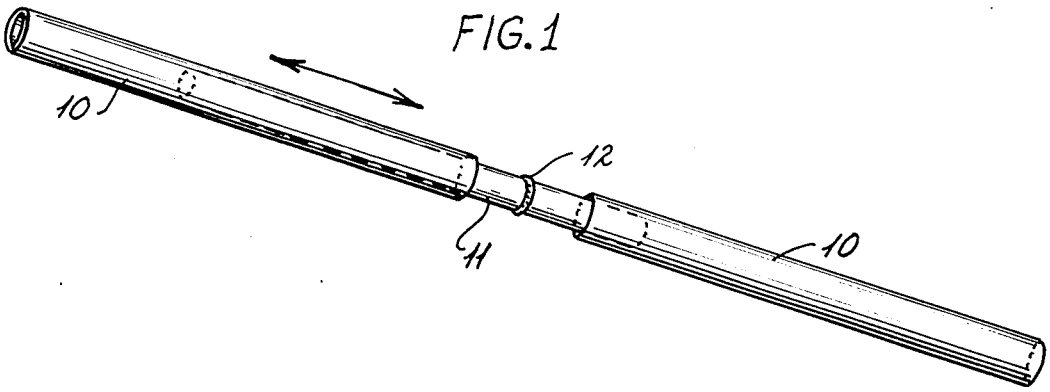
FIG. 1 is a view of a strut, showing the two side-pieces (10), the mid-piece (11) and the rubber band wrapped around the mid-piece (12).

Continued reference is made to the above drawing, reference numerals given here indicating parts similarly identified in the drawing. The measurements given in this section are for purposes of illustration only.

In the preferred embodiment each strut is made of three sections of thin-walled aluminum tubing, as follows: two 6" lengths of ¼" diameter tubing (the "side-pieces"), and one 6" length of 7/32" diameter tubing (the "mid-piece"). One of the side-pieces is fastened, by glue or otherwise, to an end of the mid-piece, allowing a 1" overlap between the two, while the other side-piece is allowed to slide freely over the remaining length of the mid-piece. The side-pieces are designated as 10 in FIG. 1; the mid-piece is designated as 11 in FIG. 1.

One or two ¼" diameter rubber bands, designated as 12 in FIG. 1, are wrapped tightly around the mid-piece. The rubber band, which can be rolled along the length of the mid-piece, serves as a brake to regulate the compressed extension of the unattached side-piece, and thus the overall length of the strut.

The struts are connected to each other with lengths of extra-strength thread with loops tied at each end ("strings"), each string measuring 16" from end to end. Each is marked at its mid-point, and at points 5⅓" from each end.

Figure 2:
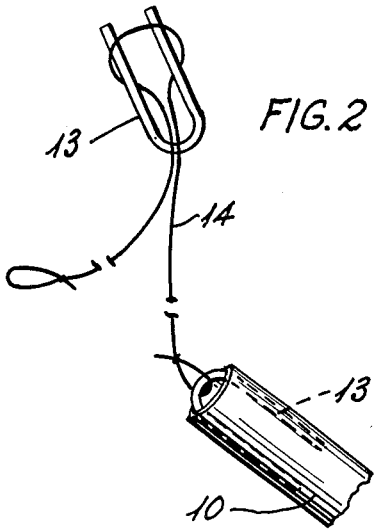
FIG. 2 shows two connector pins (13), one attached to the middle of a string (14) and the other attached to the end loop of the string.
Figure 3:
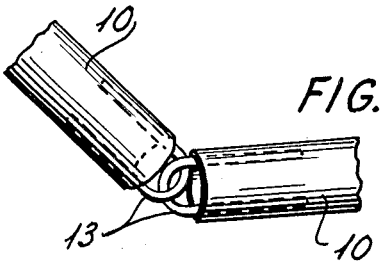
FIG. 3 shows the manner in which two struts may be connected end-to-end by two linked connector pins.

The kit also includes a plurality of 1½"–2" lengths of steel wire, folded in the middle to form a U ("connector pins"), designated as 13 in FIGS. 2 and 3. The two legs of the U are approximately ¼" apart, so that one or more connector pins may be inserted snugly into the end of a strut.

A string can be attached to the ends of a strut by hooking each end loop of the string in a connector pin and inserting the pins, feet first, into the ends of the strut. A connector pin can be attached along the length of the string by passing a loop of the string between, and then back around, the two legs of the pin, as shown in FIG. 2. The pin which has been attached along the length of the string can then be inserted into an end of a second strut.

Figure 5:
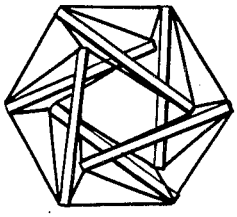
FIG. 5 shows an expanded octahedron, a six-strut diamond pattern structure.
Figure 6:
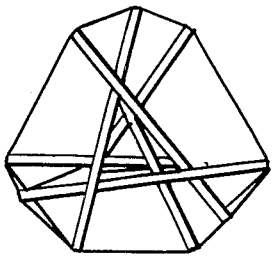
FIG. 6 shows a truncated tetrahedron, a six-strut zigzag structure.
Figure 7:
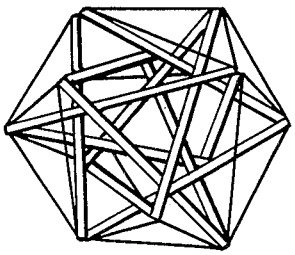
FIG. 7 shows a cuboctahedron, a twelve-strut circuit pattern structure.
Figure 4:
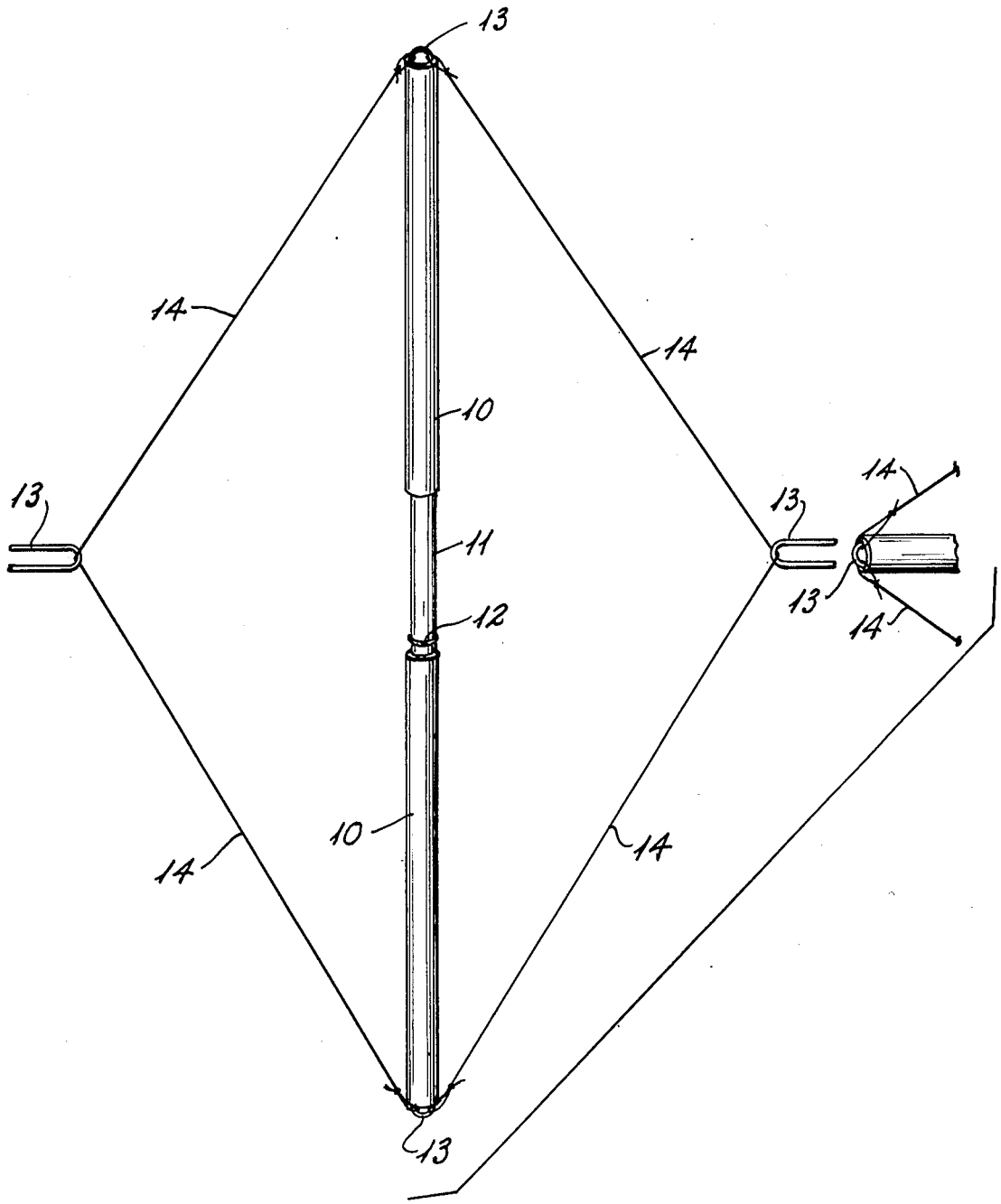
FIG. 4 shows a strut (10, 11), having two strings (14) attached from end to end, with a connector pin (13) attached at the mid-point of each string.

There are three major categories of tensegrity structures: diamond pattern structures, circuit pattern structures and zigzag structures. To construct diamond pattern structures, connector pins are attached to the midpoints of the strings, and two such strings are attached by their end loops to each strut, as in FIG. 4. The struts, collapsed to their shortest lengths, are arranged side-by-side according to a pattern. The connector pin at the midpoint of each string is then inserted feet-first into the end of a neighboring strut. The structure is then folded, the final connections are made, and the struts lengthened to take up the slack. A similar process works for circuit pattern structures, except that only one string is required for each strut. Such structures additionally require that struts be linked together, end-to-end, in "circuits". This is accomplished by linking two connector pins together and inserting them into the abutting strut ends, as shown in FIG. 3. To construct zigzag structures only one string is required for each strut but the conector pins are attached to the strings at points marking one third of the distance between the two end-points, two pins to each string. Zigzag and circuit pattern structures are most conveniently assembled by starting with the struts at their fully extended length, and shortening them as additional connections require. Examples of diamond-pattern, zigzag, and circuit pattern structures are shown in FIGS. 5, 6, and 7, respectively.

When all the connections have been made the resulting structure may be collapsable or easily deformable, because of the remaining slack in the strings. This slack can be taken up by extending the length of all or some of the telescoping struts, and securing these extensions with the rubber bands wrapped around the mid-pieces.

It is recognized that a number of alternative designs involving telescoping struts are also workable and may prove preferable in some respects to the one described here. Thus, the struts can be made of two rather than three segments. Tendons can be made of elastic, rather than inelastic thread. The struts could also be spring-loaded, in such a way that they would be at their maximum extension when unattached. The design I have proposed as a preferred embodiment of the invention is cheaply manufactured and permits assembly of the full range of tensegrity structures. If the strings break they can be readily replaced. An entire kit need consist of nothing more than the tubular strut sections, a spool of strong thread, a quantity of small rubber bands, and a supply of connector pins.

I claim:

1. A construction toy from which tensile integrity structures can be assembled, said toy comprising, a. a plurality of telescoping strut members each being composed of two or more generally rigid hollow tubular sections and fitted, at or near each of its ends, with means for attaching one or more flexible tensile members;

b. a plurality of generally flexible tensile members, each greater in length than the collapsed length of the telescoping strut members, and capable of being attached at an end point to a first telescoping strut member and, at points along its length, to a second and additional telescoping strut members, thereby joining the telescoping strut members in a discontinuous relationship.

2. A construction toy from which tensile integrity structures can be assembled, said toy comprising, a. a plurality of telescoping strut members each being composed of two or more generally rigid hollow tubular sections;

b. a plurality of generally rigid fastening members, each capable of being inserted and frictionally retained in, or otherwise attached at or near, an end of a telescoping strut member, and additionally fitted with means for attachment to one or more flexible tensile members;

c. a plurality of generally flexible tensile members, each greater in length than the collapsed length of the telescoping strut members, and capable of being attached at an end point, by means of a fastening member, to a first telescoping strut member and, by means of additional fastening members, at points along its length, to a second and additional telescoping strut members, thereby joining the telescoping strut members in a discontinuous relationship.

3. A construction toy as claimed in claims 1 or 2, and also including a pluality of elastic bands, clips, pins or the like, for the purpose of securing the telescoping struts members at various lengths.

* * * * *